US008063327B2

(12) United States Patent
Zhen

(10) Patent No.: US 8,063,327 B2
(45) Date of Patent: Nov. 22, 2011

(54) SWITCH ASSEMBLY AND ELECTRICAL DEVICE USING SAME

(75) Inventor: Nian-Feng Zhen, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 376 days.

(21) Appl. No.: 12/489,412

(22) Filed: Jun. 22, 2009

(65) Prior Publication Data

US 2009/0321241 A1 Dec. 31, 2009

(30) Foreign Application Priority Data

Jun. 27, 2008 (CN) ..... 2008 1 0302386

(51) Int. Cl.
*H01H 3/12* (2006.01)

(52) U.S. Cl. ..... 200/341

(58) Field of Classification Search ..... 200/341–345, 200/525, 437, 453, 457, 510–517, 520, 521, 200/314, 5 A
See application file for complete search history.

(56) References Cited

U.S. PATENT DOCUMENTS

| | | | | |
|---|---|---|---|---|
| 4,242,546 | A * | 12/1980 | Alonso | 200/16 A |
| 2004/0094396 | A1 * | 5/2004 | Lee et al. | 200/345 |
| 2005/0077163 | A1 * | 4/2005 | Adams et al. | 200/341 |
| 2006/0137966 | A1 * | 6/2006 | Kato | 200/512 |

* cited by examiner

*Primary Examiner* — Edwin A. Leon
(74) *Attorney, Agent, or Firm* — Altis Law Group, Inc.

(57) ABSTRACT

A switch assembly includes a shell, and a push button including a fixing member, a pushing member, an elastic member and an electrical-conductive member. A shell includes an upper surface and a cavity extending from the upper surface to a lower surface opposite to the upper surface. The fixing member is received in the cavity of the shell. The pushing member is slidably received in the fixing member and exposed out of the cavity. The elastic member is positioned between the pushing member and the shell. The electrical-conductive member is mounted on an end of the pushing member.

20 Claims, 2 Drawing Sheets

SWITCH ASSEMBLY AND ELECTRICAL DEVICE USING SAME

BACKGROUND

1. Technical Field

The disclosure relates to switch assemblies, and more particularly, to a compact switch assembly with small scale and an electrical device using the same.

2. Description of Related Art

A push button or a simply switch assembly is provided for controlling some aspect of a machine or a process. Most traditional push buttons are designed with a pair of restoring arms or elastic arms for restoring the push button to its normal position after being pushed. However, the restoring arms or elastic arms take up a large space such that the push button is bulky. Thus, the present configuration of the push button is adverse to be used in an electronic device that follows the trend of miniaturization.

Therefore, it is desirable to provide a switch assembly and an electrical device using the switch assembly to eliminate or at least alleviate the above problem.

DETAILED DESCRIPTION

Figure 1:
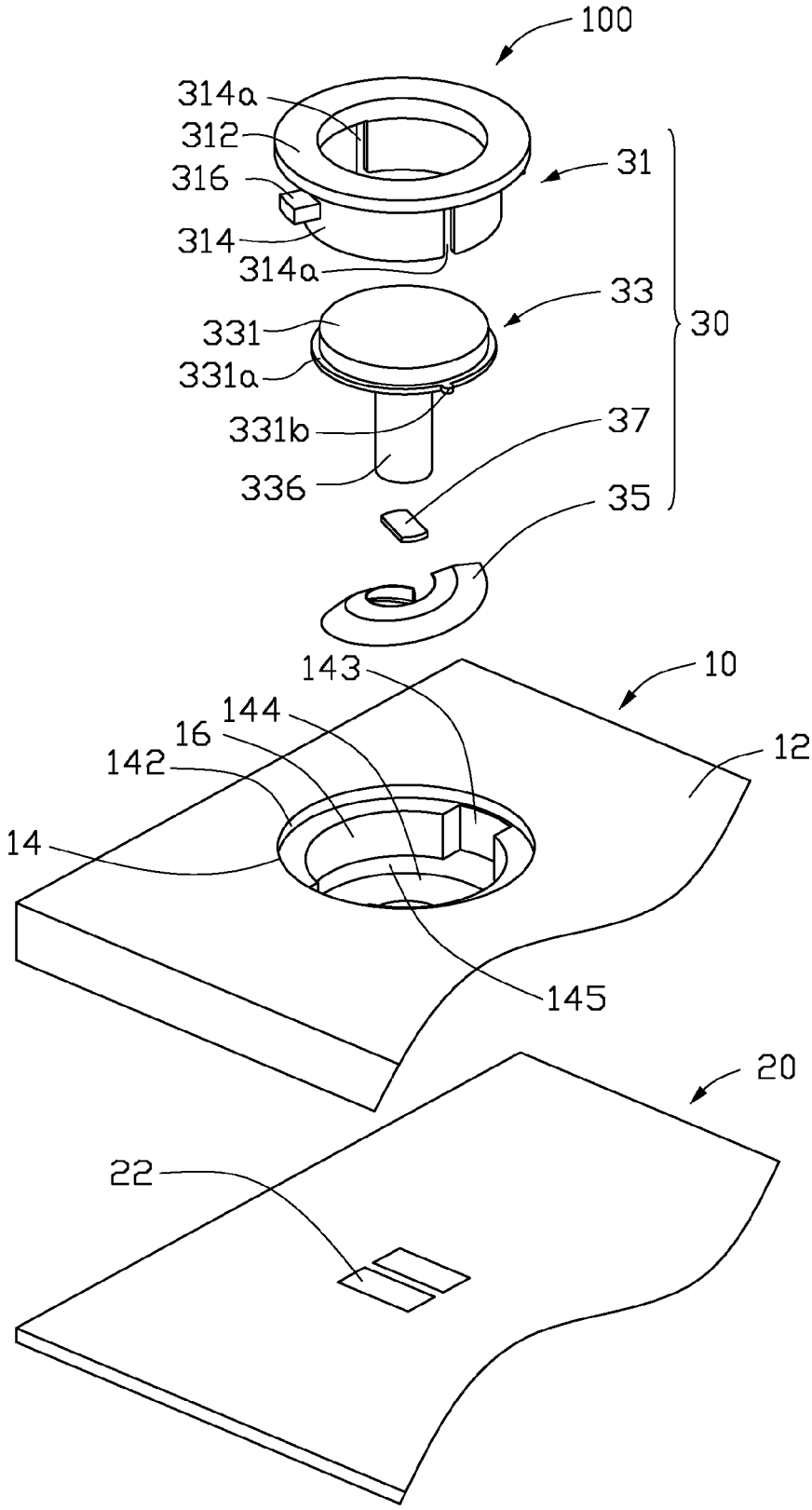
FIG. 1 is an isometric, exploded view of an electrical device according to an exemplary embodiment.
Figure 2:
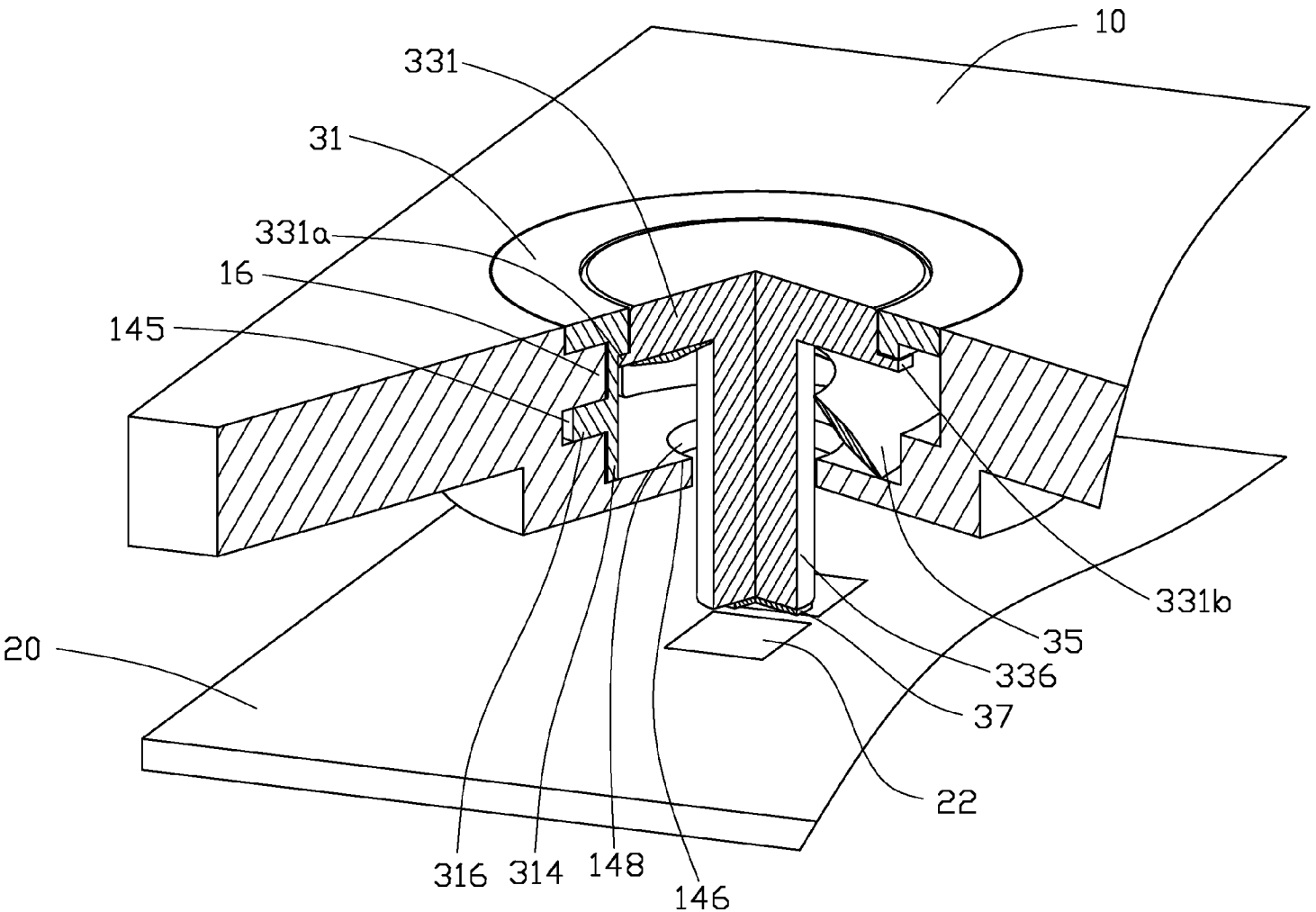
FIG. 2 is an isometric, cross section view of the electrical device of FIG. 1.

Referring to FIGS. 1-2, an electrical device 100 according to an exemplary embodiment of the present invention, includes a shell 10, a circuit board 20 received in the shell 10, and a push button 30 mounted on the shell 10 for turning on or off certain circuits of the circuit board 20. The shell 10 and the bush button 30 cooperatively form a switch assembly that is used for controlling some aspect of the circuits formed on the circuit board 20.

The shell 10 defines an upper surface 12, and a cavity 14 extending from the upper surface 12 toward a lower surface opposite to the upper surface 12. The cavity 14 defines a circumference side 142 and a bottom 146 connected to the circumference side 142. The circumference side 142 has a round step 144 extending inwardly along the circumferential direction of the circumference side 142. The bottom 146 defines a through hole 148 running through the center thereof. The shell 10 further includes a pair of curved protrusions 16 evenly formed on the circumference side 142. The pair of the curved protrusions 16 is parallel to the step 144 of the circumference side 142 and away from the step 144 at a certain distance. Thereby, a pair of passages 143 is formed between the pair of protrusions 16, and a channel 145 is formed between the protrusions 16 and the step 144 to communicate with the passages 143.

The circuit board 20 is engaged with the shell 10 and includes a pair of electrical contacts 22 formed thereon. The electrical contacts 22 are aligned to the through hole 148 of the shell 10 when the circuit board 20 is assembled with the switch assembly. It is to be noted that, the pair of electrical contacts 22 is disconnected and can be electrically connected to each other by the push button 30.

The push button 30 is positioned in the cavity 14 and passes the through hole 148 of the shell 10. The push button 30 includes a fixing member 31, a pushing member 33, an elastic member 35 and an electrical-conductive member 37. The pushing member 33 is slidably received in the fixing member 31. The elastic member 35 is positioned between the pushing member 33 and the bottom 146 of the cavity 14. The electrical-conductive member 37 is mounted on an end of the pushing member 33.

The fixing member 31 defines a top ring 312 engaged with the protrusions 16 of the shell 10, a bushing 314 extending downward from a bottom of the top ring 312 and coaxial with the top ring 312, and at least a pair of blocks 316 symmetrically extending outward from an outer surface of the bushing 314 along a circumferential direction. The bushing 314 of the fixing member 31 is attached on the bottom 146 of the cavity 14 when the push button 30 is received in the cavity 14 of the shell 10. The bushing 314 defines a pair of slots 314*a* extending through an inner surface and an outer surface along a center axis direction of the bushing 314. The bushing 314 has an inner diameter bigger than the diameter of the inner-circumference of the top ring 312, and the bushing 314 therefore can receive the pushing member 33 to prevent the pushing member 33 from disengaging with the fixing member 31. The blocks 316 are inserted into the channel 145 through the passages 143 and then offset from the position aligned with the passages 143.

The pushing member 33 includes a keycap 331, and a push rod 336. The keycap 331 is slidably received in the bushing 314 of the fixing member 31. The push rod 336 extends downward from a bottom of the keycap 331. The keycap 331 includes a flange 331*a* protruding outwards from an outer surface of the keycap, and a pair of slide projections 331*b* symmetrically received in the corresponding slots 314*a* of the bushing 314 and formed on the flange 331*a*. The diameter of the keycap 331 is smaller than the diameter of the inner-circumference of the top ring 312. Thus, when the keycap 331 is assembled with the fixing member 31, the keycap 331 can pass through the top ring 312 when pushed. The flange 331*a* has an outer diameter larger than the diameter of the inner-circumference of the top ring 312 so that the pushing member 33 is limited between the fixing member 31 and the shell 10. The push rod 336 extends downwards from the bottom of the keycap 331 and passes through the through hole 148 of the bottom 146 to align with the electrical contacts 22 of the circuit board 20.

The elastic member 35 is sleeved on the push rod 336 and may be resiliently compressed between the bottom 146 of the shell 10 and the keycap 331 of the pushing member 30 when pushing the keycap 331 towards the through hole 148 of the shell 10. The elastic member 35 may be a spiral spring or a helical leaf spring.

The electrical-conductive member 37 is mounted on the distal end of the push rod 336 away from the keycap 331 and can electrically connect the electrical contacts 22 of the circuit board 20 when the keycap 331 is pressed. Alternatively, the electrical-conductive member 37 can be a metal piece or a conductive adhesive coated on the distal end of the push rod 336.

In present invention, the fixing member 31 is employed to fix the pushing member 33, and the elastic member 37 is employed to provide a restoring force to return the pushing member 33 to a normal position. Therefore, the elastic arms or restoring members used in the prior art is omitted and the switch assembly is compact and miniaturized.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A switch assembly comprising:

a shell comprising an upper surface and a cavity extending from the upper surface to a lower surface opposite to the upper surface, the cavity defining a circumference side comprising a round step formed thereon; and a push button positioned through the cavity of the shell and comprising:

a fixing member received in the cavity and supported on the step of the shell;

a pushing member slidably received in the fixing member and exposed out of the cavity;

an elastic member positioned between the pushing member and the shell; and an electrical-conductive member mounted on an end of the pushing member.

2. The switch assembly as claimed in claim 1, wherein the cavity further defines a bottom connected on the circumference side; the bottom defines a through hole running through a center thereof; the shell further comprises as pair of curved protrusions evenly formed on the circumference side; the protrusions are parallel to the step and apart from the step by a certain distance; and the elastic member is positioned between the pushing member and the bottom of the cavity.

3. The switch assembly as claimed in claim 2, wherein the curved protrusions define a pair of passages there-between and a channel between the curved protrusions and the step to communicate with the passages.

4. The switch assembly as claimed in claim 3, wherein the fixing member defines a top ring engaged with the protrusions of the shell, a bushing extending downward from a bottom of the top ring and attached on the bottom of the cavity, and at least a pair of blocks symmetrically extending outward from the outer surface of the bushing along the circumferential direction and inset in the channel of the shell.

5. The switch assembly as claimed in claim 4, wherein an inner diameter of the bushing is bigger than that of the top ring so that the bushing can receive the pushing member therein, and the top ring can therefore prevent the pushing, member from disengaging with the fixing member.

6. The switch assembly as claimed in claim 5, wherein the pushing member comprises a keycap slidably received in the bushing of the fixing member, and a push rod extending downwards from a bottom of the keycap and extending out from the through hole of the bottom of the shell.

7. The switch assembly as claimed in claim 6, wherein the keycap comprises a flange protruding outwards from an outer surface thereof along the circumferential direction; an outer diameter of the keycap is smaller than the diameter of the inner-circumference of the top ring, the keycap can therefore expose out from the top ring; and an outer diameter of the flange is bigger than the diameter of the inner-circumference of the top ring to prevent the pushing member from breaking away from the fixing member.

8. The switch assembly as claimed in claim 7, wherein the bushing defines a pair of slots extending through an inner and an outer surfaces thereof along the axis direction of the bushing; and the flange of the keycap defines a pair of slide projections symmetrically formed thereon which are received in the slots of the bushing correspondingly.

9. The switch assembly as claimed in claim 6, wherein the elastic member is sleeved on the push rod and is resiliently compressed between the bottom of the shell and the keycap of the pushing member when pushing the keycap towards the through hole of the shell.

10. The switch assembly as claimed in claim 1, wherein the elastic member is selected from spiral spring or a helical leaf spring.

11. An electrical device comprising:

a shell comprising an upper surface and a cavity extending from the upper surface to a lower surface opposite to the upper surface, the cavity defining a circumference side comprising a round step formed thereon;

a circuit board engaged with the shell and comprising at least one pair of disconnected electronic contacts formed thereon corresponding to the cavity; and a push button positioned through the cavity of the shell and comprising:

a fixing timber received in the cavity and supported on the step of the shell;

a pushing member slidably received in the fixing member and extending out from the cavity to align with the contacts of the circuit board;

an elastic member positioned between the pushing member and the shell; and an electrical-conductive member mounted on an end of the pushing member and configured for electrically connecting the at least one pair of contacts of the circuit board when the pushing member of the push button is pressed.

12. The electrical device as claimed in claim 11, wherein the cavity further defines a bottom connected on the circumference side; the bottom defines a through hole running through a center thereof; the shell further comprises a pair of curved protrusions evenly formed on the circumference side; the protrusions are parallel to the step and apart from the step by a certain distance; and the elastic member is positioned between the pushing member and the bottom of the cavity.

13. The electrical device as claimed in claim 12, wherein the curved protrusions define a pair of passages there-between and a channel formed between the curved protrusions and the step to communicate with the passages.

14. The electrical device as claimed in claim 13, wherein the fixing member defines a top ring engaged with the protrusions of the shell, a bushing extending downward from a bottom of the top ring and attached on the bottom of the cavity, and at least a pair of blocks symmetrically extending outward from the outer surface of the bushing along, the circumferential direction and inset in the channel of the shell.

15. The electrical device as claimed in claim 14, wherein an inner diameter of the bushing is bigger than that of the top ring so that the bushing can receive the pushing member therein, and the to ring can therefore prevent the pushing member from disengaging with the fixing member.

16. The electrical device as claimed in claim 15, wherein the pushing member comprises a keycap slidably received in the bushing of the fixing member, and a push rod extending downward from a bottom of the keycap and extending out from the through hole of the bottom of the shell.

17. The electrical device as claimed in claim 16, wherein the keycap comprises a flange protruding outwards from an outer surface thereof along the circumferential direction; an outer diameter of keycap is smaller than the diameter of the inner-circumference of the top ring, the keycap can therefore expose out from the top ring; and an outer diameter of the flange is bigger than the diameter of the inner-circumference of the top ring to prevent the pushing member from breaking away from the fixing member.

18. The electrical device as claimed in claim 17, wherein the bushing defines a pair of slots extending through an inner and an outer surfaces thereof along the axis direction of the bushing; and the flange of the keycap defines a pair of slide projections symmetrically formed thereon which are received in the slots of the bushing correspondingly.

19. The electrical device as claimed in claim 16, wherein the elastic member is sleeved on the push rod and is resiliently compressed between the bottom of the shell and the keycap of the pushing member when pushing the keycap towards the through hole of the shell.

20. The electrical device as claimed in claim 11, wherein the elastic member is selected from spiral spring or a helical leaf spring.

* * * * *